US005173472A

United States Patent [19]

Mito et al.

[11] Patent Number: 5,173,472

[45] Date of Patent: Dec. 22, 1992

[54] HEAT SENSITIVE RECORDING MATERIAL

[75] Inventors: Hisayoshi Mito, Amagasaki; Masato Kawamura, Nishinomiya; Mikio Nakamura, Kobe, all of Japan

[73] Assignee: Kanzaki Paper Manufacturing Co., Ltd., Japan

[21] Appl. No.: 729,231

[22] Filed: Jul. 12, 1991

[30] Foreign Application Priority Data

Jul. 13, 1990 [JP] Japan ..... 2-186616

[51] Int. Cl.[5] ..... B41M 5/30

[52] U.S. Cl. ..... 503/214; 503/225

[58] Field of Search ..... 503/214, 225; 428/150–152

[56] References Cited

U.S. PATENT DOCUMENTS 4,727,054 2/1988 Yuyama et al. ..... 503/200

*Primary Examiner*—Pamela R. Schwartz

*Attorney, Agent, or Firm*—Armstrong & Kubovcik

[57] ABSTRACT

The present invention provides a heat sensitive recording material comprising a substrate and a heat sensitive recording layer formed thereon and having incorporated therein a colorless or light-colored basic dye and a color acceptor reactive with the dye when contacted therewith by heating, the heat sensitive recording material being characterized in that the heat sensitive recording layer has incorporated therein a polyvinyl alcohol having an average polymerization degree of at least 1000 and a saponification degree of up to 90 mole %, and a modified starch.

12 Claims, No Drawings

HEAT SENSITIVE RECORDING MATERIAL

The present invention relates to a coating composition which is usable without any coating trouble due to an increased viscosity for forming a heat sensitive recording layer, and to a heat sensitive recording material which has a high sensitivity, comprises the layer of coating composition and is usable with greatly diminished adhesion of tailings to the thermal recording head.

Heat sensitive recording materials are well known which are adapted to produce color images by thermally contacting a colorless or light-colored basic dye with a color acceptor for a color forming reaction.

Communication recording devices, such as facsimile systems, for use with heat sensitive recording materials have been rapidly introduced into wide use in recent years because of their convenience, and made operable at a higher speed. Accordingly, various proposals have been made to provide heat sensitive recording materials having an enhanced sensitivity as required. As a preferred method of giving enhanced sensitivities, it is known to incorporate into the recording layer a heat-fusible substance which is highly compatible and readily miscible with the basic dye and color acceptor on melting in a suitable temperature range. Nevertheless, it has been found that such heat-fusible substances which are effective for giving enhanced sensitivities develop the trouble that when the thermal head is used continuously for printing, the substance permits adhesion of tailings to the head in a gradually increasing amount, allowing the tailings to deface the recording layer.

It is generally thought that the composition of the adhesive and pigment which are some components of the coating composition also influences the adhesion of tailings. Extensive investigations have been made of adhesives for use in the coating composition for forming heat sensitive recording layers, whereas for example if an increased amount of adhesive, or a different adhesive is used to obviate the adhesion of tailings, other adverse effects will result such as a greatly reduced work efficiency due to a rise in the viscosity of the coating composition, or, much lower recording sensitivity and marked degradation of recorded images. Accordingly, it has been strongly desired to provide a heat sensitive recording material which is usable free of the adhesion of tailings, the attendant printing trouble and like drawbacks without entailing these adverse effects and to develop a process for producing the material.

An object of the present invention is to provide a heat sensitive recording material which is coated with a composition free of the trouble due to an increased viscosity thereof and which has excellent sensitivity and is very satisfactorily improved especially in diminishing the adhesion of tailings to the thermal recording head.

The above and other objects of the invention will become apparent from the following description.

The present invention provides a heat sensitive recording material comprising a substrate and a heat sensitive recording layer formed thereon and having incorporated therein a colorless or light-colored basic dye and a color acceptor reactive with the dye when contacted therewith by heating, the heat sensitive recording material being characterized in that the heat sensitive recording layer has incorporated therein a polyvinyl alcohol having an average polymerization degree of at least 1000 and a saponification degree of up to 90 mole %, and a modified starch.

It is generally desired that the adhesive for use in heat sensitive recording layers be excellent in dispersibility in the coating composition and in adhesion, impart good viscosity stability to the composition and be inexpensive. Additionally, the adhesive for use in heat sensitive recording layers must be satisfactorily meltable and less likely to fog the background, to stick to the thermal head and to permit adhesion of tailings to the thermal head.

As an adhesive for use in heat sensitive recording materials are proposed, for example, water-soluble compounds such as polyvinyl alcohol, modified starch, casein, gelatin, soybean protein, carboxymethylcellulose, methylcellulose, hydroxyethylcellulose, gum arabic, sodium alginate, polyacrylamide and sodium polyacrylate, aqueous emulsions of styrene-butadiene copolymer, styrene-butadiene-acrylonitrile copolymer, ethylene-vinyl acetate copolymer, vinylidene chloride-acrylic acid ester copolymer, vinylidene chloride-acrylonitrile copolymer, acrylonitrile-acrylic acid ester copolymer, polyurethane resin, chlorinated polypropylene resin, butadiene-acrylonitrile copolymer, vinyl acetate resin and the like. Among them, polyvinyl alcohol is mainly used in view of adhesive property.

However, polyvinyl alcohol is insufficient in sticking and adhesion of tailings, while conjoint use of a curing agent to remedy this drawback entails background fogging and an increase in the viscosity of the coating composition to result in a problem as to work efficiency during preparation of the coating composition or coating operation. Further when partially saponified polyvinyl alcohol having a polymerization degree of at least 1000 is used, the viscosity of the coating composition rises markedly with an increase in the polymerization degree to seriously affect the work efficiency although some improvement can then be achieved in preventing the adhesion of tailings. Further the other water-soluble adhesives and synthetic resin emulsions are not usable without entailing fault in respect of adhesion, background fogging, sticking or adhesion of tailings.

Accordingly, we have conducted extensive research on various adhesives in order to obtain a heat sensitive recording material which can be prepared without entailing a reduction in work efficiency due, for example, to a rise in the viscosity of the coating composition for the heat sensitive recording layer and which is greatly diminished in the adhesion of tailings to the thermal head. Consequently, we have found that such a material of desired quality can be obtained by incorporating into the heat sensitive recording layer a polyvinyl alcohol having a saponification degree of up to 90 mole %, preferably 70 to 90 mole %, more preferably 80 to 90 mole % , and an average polymerization degree of at least 1000, preferably 1000 to 10000, more preferably 1000 to 5000, most Preferably 1700 to 5000, and modified starch. In the present invention, "polyvinyl alcohol" means an unmodified polyvinyl alcohol.

The modified starch for use in the invention is not limited specifically in kind. Suitable for use are those generally known for use in papermaking, such as oxidized starch, enzyme converted starch, esterified starch, cationic starch, grafted starch, etherified starch, α-starch, etc.

Oxidized starch is one which obtained by depolymerizing a part of starch molecules, by oxidizing a starting starch such as potato starch, corn starch and tapioca starch with an oxidizing agent such as sodium hypochlorite, hydrogen peroxide, potassium permanganate and periodic acid. Enzyme converted starch is prepared by depolymerizing a starting starch with use of amylase or like enzyme. Esterified starch includes, for example, starch acetate obtained by reacting a starting starch with acetic acid, acetic anhydride, etc. and starch phosphate prepared by the reaction of a starting starch and sodium dihydrogenphosphate, phosphorus oxychloride, phosphoric anhydride, trimetaphosphoric acid, etc. Cationic starch :s prepared by reacting a starting starch with a cationic modifier such as ethyleneimine, halogenated alkylamine, epoxyalkyltrialkylammonium salt, etc. Further, qrafted starch is obtained by grafting to a starting starch a vinyl monomer such as acrylic acid, acrylonitrile, acrylamide, methacrylate and vinyl acetate. Etherified starch includes, for example, carboxymethylated starch obtained by reacting a starting starch with monochloroacetic acid, and hydroxyethylated starch obtained by reacting a starting starch with ethylene oxide. α-Starch is prepared by cooking an aqueous dispersion of a starting starch to obtain α-starch and drying by use of a hot roll or spray drier.

In the present invention, the degree of modification of the above modified starch is not particularly limited and the modified starch is used which has a viscosity of preferably 30 to 10000 cps, more preferably 30 to 5000 cps when a 20% by weight o1 aqueous solution of the starch is measured at 50° C. by Brookfield viscometer.

Although research still remains to be made to fully clarify why the use of the above specific polyvinyl alcohol and the modified starch diminishes the adhesion of tailings to the thermal head without entailing an increase in the viscosity of the coating composition for a recording layer, the reason appears attributable primarily to delicate interaction between the high degree of polymerization and the high affinity of the unsaponified portion of the polyvinyl alcohol for the particles of color forming agents such as the dye, color acceptor and sensitizer (heat-fusible substance) to firmly bond the color forming particles to the substrate or particles of the pigment or the like and to thereby inhibit the adhesion of tailings. Moreover, the modified starch will exert a delicate influence on the dispersibility of components of the coating composition to thereby inhibit the increase in the viscosity of the composition.

While the ratio of the polyvinyl alcohol to the modified starch to be used therewith is to be determined, for example, in view of the viscosity of the coating composition, adhesion of tailings and adhesive property, the ratio in terms of solids is preferably 10:90 to80:20, more preferably 15:85 to 60:40.

Incidentally, when the ratio of the specified polyvinyl alcohol to the modified starch is lower than 10:90 with an excess of starch, lower bond strength will result, giving rise to problems as to edge dust in a finishing process of a heat sensitive recording material or when the recording material is cut on a recording device. Further, when the recorded material is folded, the record image peels off along the folding line. Thus, it is difficult to obtain a heat sensitive recording material having sufficient quality. Further if the proportion of polyvinyl alcohol exceeds the ratio of 80:20, an increase in the viscosity of the coating composition is more likely to lead to a lower work efficiency.

In the present invention, the amount of the adhesive consisting of a specific polyvinyl alcohol and modified starch is not limited specifically and is adjusted to the range of 5 to 40 wt. % , preferably 10 to 30 wt. % , of the total solids of the coating composition for forming the recording layer.

While the present invention is characterized in that the heat sensitive recording layer has incorporated therein the above-specified polyvinyl alcohol and modified starch, at least two kinds of such polyvinyl alcohols, as well as of such starches, are conjointly usable. Furthermore, adhesives other than those specified above can be used conjointly insofar as the contemplated effect of the invention can be assured.

Examples of such adhesives are an unmodified polyvinyl alcohol having a saponification degree of above 90 mole % or an average polymerization degree of less than 1000, various modified polyvinyl alcohols such as carboxyl-, sulfonic acid-, acetoacetyl- and silicon-modified ones, casein, gelatin, soybean protein, carboxymethylcellulose, methylcellulose, hydroxyethylcellulose, gum arabic, sodium alginate, polyacrylamide and sodium polyacrylate, aqueous emulsions of styrene-butadiene copolymer, styrene-butadiene-acrylonitrile copolymer, ethylene-vinyl acetate copolymer, vinylidene chloride-acrylic acid ester copolymer, vinylidene chloride acrylonitrile copolymer, acrylonitrile-acrylic acid ester copolymer, polyurethane resin, chlorinated polypropylene resin, butadiene-acrylonitrile copolymer, vinyl acetate resin, etc.

In the present invention, colorless or light-colored basic dyes for providing the heat sensitive recording layer include those already known and including the following examples.

Triarylmethane-based dyes, e.g., 3,3-bis(p-dimethylaminophenyl)-6-dimethylaminophthalide, 3,3-bis(p-dimethylaminophenyl)phthalide, 3-(p-dimethylaminophenyl)-3-(1,2-dimethylindole-3-yl)phthalide, 3-(p-dimethylaminophenyl)-3-(2-methylindole-3-yl)phthalide 3,3-bis(1,2-dimethylindole-3-yl)-5-dimethylaminophthalide, 3,3-bis(1,2-dimethylindole-3-yl)-6-dimethylaminophthalide 3,3-bis(9-ethylcarbazole-3-yl)-6-dimethylaminophthalide, 3,3-bis(2-phenylindole-3-yl)-6-dimethylaminophthalide, 3-p-dimethylaminophenyl-3-(1-methylpyrrole-3 yl)-6-dimethylaminophthalide, etc.

Diphenylmethane-based dyes, e.g., 4,4'-bis-dimethylaminobenzhydryl benzyl ether, N-halophenylleucoauramine, N-2,4,5-trichlorophenyl-leucoauramine, etc.

Thiazine-based dyes, e.g., benzoyl-leucomethyleneblue, p-nitrobenzoyl-leucomethyleneblue, etc.

Spiro-based dyes, e.g., 3-methyl-spirodinaphthopyran, 3-ethyl-spiro-dinaphthopyran, 3-phenyl-spirodinaphthopyran, 3-benzyl-spiro-dinaphthopyran. 3-methylnaphtho-(6'-methoxybenzo)spiropyran, 3-propyl-spirodibenzopyran, etc.

Lactam-based dyes, e.g., rhodamine-B-anilinolactam, rhodamine-(p-nitroanilino)lactam, rhodamine-(o-chloroanilino)lactam, etc.

Fluoran-based dyes, e.g., 3-dimethylamino-7-methoxyfluoran, 3-diethylamino-6-methoxyiluoran, 3-diethylamino-7-methoxyiluoran, 3-diethylamino-7-chlorofluoran, 3-diethylamino-6-methyl-7-chlorofluoran, 3-diethylamino-6,7-dimethylfluoran. 3-(N-ethyl-p-toluidino)-7-methylfluoran, 3-diethylamino-7-(N-acetyl-N-methylamino)fluoran, 3-diethylamino-7-N-methylaminofluoran, 3-diethylamino-7-dibenzylaminofluoran 3-diethylamino-7-(N-methyl-N-benzylamino)-fluoran, 3-diethyl-amino-7-(N-chloroethyl-N-methylamino)fluoran, 3-diethylamino-7-diethylaminofluoran, 3-(N-ethyl-p-toluidino)-6-methyl-7-phenylaminofluoran, 3-(N-ethyl-p-toluidino)-6-methyl-7-(p-toluidino)fluoran, 3-diethylamino-6-methyl-7-phenylaminofluoran, 3-di-n-butylamino-6-methyl-7-phenylaminofluoran, 3-di-n-pentylamino-6-methyl-7-phenylaminofluoran, 3-diethylamino-7-(2-carbomethoxyphenylamino)fluoran, 3-(N-ethyl-N-isoamylamino)-6-methyl-7-phenylaminofluoran, 3-(N-cyclohexyl-N-methylamino)-6-methyl-7-phenylaminofluoran, 3-pyrrolidino-6-methyl-7-phenylaminofluoran, 3-piperidino-6-methyl-7-phenylaminofluoran, 3-diethylamino-6-methyl-7-xylidinofluoran, 3-diethylamino-7-(o-chlorophenylamino)fluoran, 3-di-n-butylamino-7-(o-chlorophenylamino)fluoran, 3-pyrrolidino-6-methyl-7-p-butylphenylaminofluoran, etc. These basic dyes are not limited thereabove and can be used, as required, in a mixture of at least two of them. Among these dyes preferable are 3-di-n-butylamino-6-methyl-7-phenylaminofluoran and 3-di-n-butylamino-7-(o-chlorophenylamino)fluoran, which afford a heat sensitive recording material having high whiteness.

As a color acceptor are used various compounds which are used in combination with the basic dye. The followings are examples thereof.

Inorganic acidic substances:

Activated clay, acidic clay, attapulgite, bentonite, colloidal silica and aluminum silicate.

Organic acidic substances:

Phenolic compounds, e.q., 4-tert-butylphenol, 4-hydroxydiphenoxide, α-naphthol, β-naphthol, 4-hydroxyacetophenone, 4-tert-octylcatechol, 2,2'-dihydroxydiphenol, 2.2'-methylenebis(4-methyl-6-tert-isobutylphenol), 4,4'-isopropylidenebis(2-tert-butylphenol), 4,4'-sec-butylidene-diphenol, 4-phenylphenol, 4,4'-isopropylidenediphenol (bisphenol A), 4-hydroxyphenyl-4'-isopropoxyphenylsulione, 2,2'-methylenebis(4-chlorophenol), hydroquinone, 4,4'-cyclohexylidenediphenol, benzyl 4-hydroxybenzoate, dimethyl 4-hydroxyphthalate, hydroquinone monobenzyl ether, novolak phenol resin and phenolic polymer.

Aromatic carboxylic acids, e.g.. benzoic acid, p-tert-butylbenzoic acid, trichlorobenzoic acid, terephthalic acid, 3-sec-butyl-4-hydroxybenzoic acid, 3-cyclohexyl-4-hydroxybenzoic acid, 3,5-dimethyl-4-hydroxybenzoic acid salicylic acid, 3-isopropylsalicylic acid, 3-tert-butylsalicylic acid 3-benzylsalicylic acid, 3-(α-methylbenzyl)salicylic acid, 3-chloro-5-(α-methylbenzyl)salicylic acid, 3 5-di-tert-butylsalicylic acid, 3-phenyl-5-(α,α-dimethylbenzyl)salicylic acid and 3,5-di-(α-methylbenzyl)salicylic acid.

Salt of the above phenolic compound or aromatic carboxylic acid with a polyvalent metal such as zinc, magnesium, aluminum, calcium, titanium, manganese, tin and nickel.

Metal complex, e.g., antipyrine complex with zinc thiocyanate.

With the heat sensitive recording materials of the invention, the proportions of the basic dye and color acceptor in the recording layer are not particularly limited and usually 1 to 50 parts by weight, preferably 1 to 10 parts by weight of the color acceptor is used per part by weight of the basic dye.

Further, a sensitizer can be added as required in the heat sensitive recording layer. Examples of useful sensitizers are caproic acid amide, capric acid amide, palmitic acid amide, stearic acid amide, oleic acid amide, erucic acid amide, linoleic acid amide, linolenic acid amide, N-methylstearic acid amide, stearic acid anilide, N-methyloleic acid amide, benzanilide, linoleic acid anilide, N-ethylcapric acid amide, N-butyllauric acid amide, N-octadecylacetamide, N-oleylacetamide, N-oleylbenzamide, N-stearylcyclohexylamide, polyethylene glycol, 1-benzyloxynaphthalene, 2-benzyloxynaphthalene, 1-hydroxynaphthoic acid phenyl ester, 1,2-diphenoxyethane, 1,4-diphenoxybutane, 1,2-bis(3-methylphenoxy)ethane, 1,2-bis(4-methoxyphenoxy)ethane, 1-phenoxy-2-(4-chlorophenoxy)ethane, 1-phenoxy-2-(4-methoxyphenoxy)ethane, 1-(2-methylphenoxy)-2-(4-methoxyphenoxy)ethane, dibenzyl terephthalate, dibenzyl oxalate, di(4-methylbenzyl) oxalate, benzyl p-benzyloxybenzoate, p-benzylbiphenyl, 1,5-bis(p-metboxyphenoxy)-3-oxapentane, 1,4-bis(2-vinyloxyethoxy)benzene, p-biphenyl p-tolyl ether and benzyl p-methylthiophenyl ether.

Among these sensitizers, more preferable to use are 1,2-diphenoxyethane, 1,2-bis(3-methylphenoxy)ethane, 1-(2-methylphenoxy)-2-(4-methoxyphenoxy)ethane, dibenzyl oxalate and di(4-methylbenzyl)oxalate because these compounds afford heat sensitive recording materials which are excellent not only in recording density but also in whiteness and image stability.

It is desired that the amount of sensitizer to be used be adjusted generally within the range of up to about 400 Parts by weight per 100 parts by weight of the color acceptor although not limited specifically.

The coating composition for a recording layer comprising these substances is prepared generally by dispersing the basic dye, color acceptor and as required sensitizer, separately or together, in water as a dispersing medium using a stirring-pulverizing machine such as a ball mill, attritor or sand mill. It is desirable to use these components such as the basic dye and color acceptor as pulverized to a mean particle size of up to 1.2 μm, preferably up to 0.9 μm. A heat sensitive recording material of high sensitivity is then available.

In the present invention, the above specific adhesive is incorporated in the coating composition for a recording layer.

Various auxiliary agents can be further incorporated into the coating composition for forming the heat sensitive recording layer of the present invention. Examples of such agents are sodium dioctylsulfosuccinate, sodium dodecylbenzenesulfonate, sodium lauryl sulfate, alginic acid salt, fatty acid metal salt and like dispersants, benzophenone and triazole ultraviolet absorbers, defoaming agents, fluorescent dyes, coloring dyes, etc. Further suitably usable as required are lubricants such as zinc stearate, calcium stearate, polyethylene wax, carnauba wax, paraffin wax and ester wax, various pigments including inorganic pigments such as kaolin, clay, talc, calcium carbonate, magnesium carbonate, calcined clay, titanium oxide, kieselguhr, fine particulate anhydrous silica, activated clay and aluminum hydroxide, and organic pigments such as styrene microballs, nylon powder, urea-formaline resin filler and raw starch, etc.

The coating composition for a recording layer thus prepared is generally applied to a substrate and dried to form a recording layer. The method of applying the coating composition to the substrate is not limited specifically but can be any of those already known and used in the prior art. These methods include, for example, bar coating, air knife coating, rod blade coating, pure blade coating, short-dwell coating, curtain coating and die coating.

The substrate for use in the heat sensitive recording material of the present invention is, for example, paper, plastics film, synthetic paper or the like. In the case where a plastics film is used as the substrate, the substrate surface can be treated as by corona discharge or irradiation with electron rays to achieve an improved coating efficiency.

Although not limited specifically, the amount of coating composition to be applied is adjusted within the range usually of 0.5 to 15 g/m , preferably of about 1.5 to about 10 g/m$^2$, by dry weight.

The heat sensitive recording material of the present invention can be formed with a protective layer over the recording layer for preventing color formation due to frictional contact of the recording surface with other article or exposure to solvents. Further if the substrate for use in the heat sensitive recording material of the present invention is low in surface smoothness, a middle layer can be interposed between the substrate and the recording layer to compensate for the low smoothness of the substrate. Moreover, the middle layer, when incorporating a bulky pigment, will be useful for giving a heat-insulating effect, making it possible to efficiently utilize the heat energy from the thermal head for color formation and thereby impart improved sensitivity to the recording material.

Further when required, the heat sensitive recording layer or protective layer formed can be treated by a supercalender so as to improve the quality and density of images to be recorded. Thus, various techniques already known in the art of producing heat sensitive recording materials can be used additionally as required, which include, for example, application of an adhesive to the rear surface of the recording material for preparing adhesive labels.

The present invention will be described in greater detail with reference to the following examples, to which the invention is of course not limited. In these examples, the parts and percentages are all by weight unless otherwise specified.

EXAMPLE 1

| | | |
|---|---|---|
| (1) | Formation of Middle Layer | |
| | Calcined clay (Ansilex, product of Engelhard Minerals & Chemicals Corp.) | 100 parts |
| | 50% Styrene-butadiene copolymer latex | 20 parts |
| | 10% Aqueous solution of polyvinyl alcohol (PVA110, product of Kuraray Co., Ltd.) | 20 parts |
| | Water | 270 parts |

The above ingredients were mixed together by stirring and made into a coating composition for a middle layer. The composition prepared was applied to wood-free paper weighing 48 g/m$^2$ in an amount of 7 g/m$^2$ when dried, followed by drying to form the middle layer.

| | | |
|---|---|---|
| (2) | Preparation of Composition A | |
| | 3-(N-ethyl-N-isoamylamino)-6-methyl-7-phenylaminofluoran | 10 parts |
| | 1,2-Bis(3-methylphenoxy)ethane | 30 parts |
| | 5% Aqueous solution of methylcellulose | 30 parts |
| | Water | 20 parts |

These ingredients were pulverized by a horizontal sand mill to a mean particle size of 0.8 μm.

| | | |
|---|---|---|
| (3) | Preparation of Composition B | |
| | 4,4'-Isopropylidenediphenol | 20 parts |
| | 5% Aqueous solution of methylcellulose | 15 parts |

-continued

| | |
|---|---|
| Water | 15 parts |

These ingredients were pulverized by a horizontal sand mill to a mean particle size of 1.0 μm.

(4) Formation of Recording Layer

A coating composition was prepared from 90 parts of composition A, 50 parts of composition B, 80 parts of 6% aqueous solution of a polyvinyl alcohol having an average polymerization degree of 3500 and a saponification degree of 88% (PVA-235, product of Kuraray Co. Ltd.) and 220 parts of 6% aqueous solution of oxidized starch (Ace A, product of Oji Corn Starch Co,. Ltd., 4600 cps in Brookfield viscosity at 50° C. of 20% aqueous solution), both serving as adhesives, 30 parts of precipitated calcium carbonate (Cal-light KT, product of Shiraishi Kogyo Co., Ltd.) and 30 parts of 30% aqueous dispersion of zinc stearate by mixing these ingredients together by stirring.

The coating composition obtained was applied by a rod blade coater to the middle layer in an amount of 5 g/m$^2$ when dried, followed by drying to form a heat sensitive recording layer. The layer was subsequently treated by a supercalender to prepare a heat sensitive recording material.

EXAMPLE 2

A heat sensitive recording material was prepared in the same manner as in Example 1 except that a 6% aqueous solution of starch phosphate (MS-4600, product of Nihon Shokuhin Kako Co., Ltd., 75 cps in Brookfield viscosity at 50° C. of 20% aqueous solution) was used in place of the oxidized starch used in Example 1 for forming the recording layer.

EXAMPLE 3

A heat sensitive recording material was prepared in the same manner as in Example 1 except that a 6% aqueous solution of grafted starch (Petrocoat C-8, product of Nippon Starch Chemical Co., Ltd., 200 cps in Brookfield viscosity at 50° C. of 20% aqueous solution) was used in place of the oxidized starch used in Example 1 for forming the recording layer.

EXAMPLE 4

A heat sensitive recording material was prepared in the same manner as in Example 1 except that a 6% aqueous solution of hydroxyethylated starch (Avelex 2530, product of Avebe Co., Ltd., 70 cps in Brookfield viscosity at 50% of 20 % aqueous solution) was used in place of the oxidized starch used in Example 1 for forming the recording layer.

EXAMPLE 5

A heat sensitive recording material was prepared in the same manner as in Example 1 except that a 6% aqueous solution of cationic starch (National 1594, product of Oji National Co., Ltd., 1500 cps in Brookfield viscosity at 50° C. of 20% aqueous solution) was used in place of the oxidized starch used in Example 1 for forming the recording layer.

EXAMPLE 6

A heat sensitive recording material was prepared in the same manner as in Example 1 except that the adhesives used in Example 1 for forming the recording layer were replaced by 110 parts of 6% aqueous solution of a polyvinyl alcohol having an average polymerization degree of 2400 and a saponification degree of 88% (PVA-224, product of Kuraray Co., Ltd.) and 190 Parts of 6% aqueous solution of oxidized starch.

EXAMPLE 7

A heat sensitive recording material was prepared in the same manner as in Example 1 except that the adhesives used in Example 1 for forming the recording layer were replaced by 150 parts of 6% aqueous solution of a polyvinyl alcohol having an average polymerization degree of 1700 and a saponification degree of 88% (PVA-217, product of Kuraray Co., Ltd.) and 150 parts of 6% aqueous solution of oxidized starch.

EXAMPLE 8

A heat sensitive recording material was prepared in the same manner as in Example 1 except that the adhesives used in Example 1 for forming the recording layer were replaced by 180 parts of 6% aqueous solution of a polyvinyl alcohol having an average polymerization degree of 1000 and a saponification degree of 88% (PVA-210, product of Kuraray Co., Ltd.) and 120 parts of 6% aqueous solution of oxidized starch.

EXAMPLE 9

A heat sensitive recording material was prepared in the same manner as in Example 1 except that the adhesives used in Example 1 for forming the recording layer were replaced by 50 parts of 6% aqueous solution of a polyvinyl alcohol having an average polymerization degree of 2000 and a saponification degree of 79.5% (PVA-420, product of Kuraray Co., Ltd.) and 250 parts of 6% aqueous solution of oxidized starch.

EXAMPLE 10

A heat sensitive recording material was prepared in the same manner as in Example 1 except that the adhesives used in Example 1 for forming the recording layer were replaced by 35 parts of 6% aqueous solution of a polyvinyl alcohol having an average polymerization degree of 3500 and a saponification degree of 88% (PVA-235, product of Kuraray Co., Ltd.) and 265 parts of 6% aqueous solution of oxidized starch.

EXAMPLE 11

A heat sensitive recording material was prepared in the same manner as in Example 8 except that the adhesives used in Example 8 for forming the recording layer were replaced by 235 parts of 6% aqueous solution of a polyvinyl alcohol having an average polymerization degree of 1000 and a saponification degree of 88% (PVA-210, product of Kuraray Co., Ltd.) and 65 parts of 6% aqueous solution of oxidized starch.

COMPARATIVE EXAMPLE 1

A heat sensitive recording material was prepared in the same manner as in Example 1 with the exception of using a polyvinyl alcohol having an average polymerization degree of 1000 and a saponification degree of 98.5% in place of the polyvinyl alcohol 3500 in average polymerization degree, 88 % in saponification degree and used in Example 1 for forming the recording layer.

COMPARATIVE EXAMPLE 2

A heat sensitive recording material was prepared in the same manner as in Example 1 with the exception of using a polyvinyl alcohol having an average polymerization degree of 1000 and a saponification degree of 98.5% in place of the oxidized starch used in Example 1.

COMPARATIVE EXAMPLE 3

A heat sensitive recording material was prepared in the same manner as in Example 8 except that a polyvinyl alcohol having an average polymerization degree of 500 and a saponification degree of 88% was used in place of the polyvinyl alcohol 1000 in average polymerization degree, 88% in saponification degree and used in Example 8.

COMPARATIVE EXAMPLE 4

A heat sensitive recording material was prepared in the same manner as in Example 1 except that 300 parts of 6% aqueous solution of oxidized starch was used in place of 80 parts of polyvinyl alcohol 3500 in average polymerization degree and 88% in saponification degree and 220 parts of oxidized starch which were used in Example 1.

COMPARATIVE EXAMPLE 5

A heat sensitive recording material was prepared in the same manner as in Comparative Example 4 except that the oxidized starch used in Comparative Example 4 was replaced by a polyvinyl alcohol having an average polymerization degree of 2400 and a saponification degree of 88% .

COMPARATIVE EXAMPLE 6

A heat sensitive recording material was prepared in the same manner as in Comparative Example 5 with the exception of using a polyvinyl alcohol having an average polymerization degree of 1700 and a saponification degree of 88% in place of the polyvinyl alcohol 2400 in average polymerization degree, 88% in saponification degree and used in Comparative Example 5.

The seventeen kinds of heat sensitive recording materials thus obtained were used on an Ohkura simulator (voltage applied: 13 V, pulse period: 0.51 ms) for recording at a pulse width of 0.45 ms. The recording density of images obtained was measured by a Macbeth reflective densitometer (Model RD-914, product of Macbeth Corp.). Table 1 shows the result.

In the Table 1,

A : oxidized starch
B : starch phosphate
C : grafted starch
D : hydroxyethylated starch
E : cationic starch The recording material was checked for the adhesion of tailings to the thermal head by printing black solid images on 30 sheets of the material of A4 size using a thermal facsimile (HIFAX 400, product of Hitachi Limited) and thereafter observing the thermal head of the apparatus. The result was evaluated according to the following criteria.

Criteria

◎: almost no adhesion of tailings.

○: The material is useful despite adhesion of some tailings.

x: Adhesion of considerable amount of tailings and practically problem.

The properties of the coating composition for forming the heat sensitive recording layer were evaluated by passing the composition through a 100-mesh screen and checking the result with the unaided eye. Table 1 also shows the result.

Criteria

○: Smooth passage.

x: Slightly less smooth passage, difficult to use.

x x: Failure to pass smoothly, unsuited to use.

Table 1 reveals that the coating compositions of the invention form heat sensitive recording layers free of troubles due, for example, to a rise in the viscosity of the composition, giving excellent recording materials having high sensitivity and greatly diminished in the adhesion of tailings to the thermal head.

TABLE 1

| | polyvinyl alcohol (PVA) ave. polyn. degree/ saponfn. degree (mole %) | starch | amounts (parts) PVA/starch (solid) | recording density | property of coating composition | adhesion of tailings |
|---|---|---|---|---|---|---|
| Ex. 1 | 3500/88 | A | 4.8/13.2 | 1.35 | ○ | ◎ |
| Ex. 2 | 3500/88 | B | 4.8/13.2 | 1.34 | ○ | ◎ |
| Ex. 3 | 3500/88 | C | 4.8/13.2 | 1.32 | ○ | ◎ |
| Ex. 4 | 3500/88 | D | 4.8/13.2 | 1.34 | ○ | ◎ |
| Ex. 5 | 3500/88 | E | 4.8/13.2 | 1.33 | ○ | ◎ |
| Ex. 6 | 2400/88 | A | 6.6/11.4 | 1.32 | ○ | ◎ |
| Ex. 7 | 1700/88 | A | 9.0/9.0 | 1.31 | ○ | ◎ |
| Ex. 8 | 1000/88 | A | 10.8/7.2 | 1.31 | ○ | ○ |
| Ex. 9 | 2000/79.5 | A | 3.0/15.0 | 1.32 | ○ | ○ |
| Ex. 10 | 3500/88 | A | 2.1/15.9 | 1.35 | ○ | ○ |
| Ex. 11 | 1000/88 | A | 14.1/3.9 | 1.32 | ○ | ○ |
| Com. Ex. 1 | 1000/98.5 | A | 4.8/13.2 | 1.31 | ○ | X |
| Com. Ex. 2 | 3500/88<br>1000/98.5 | — | 18.0/0 | 1.30 | X X | X |
| Com. Ex. 3 | 500/88 | A | 10.8/7.2 | 1.30 | X | X |
| Com. Ex. 4 | — | A | 0/18.0 | 1.32 | ○ | X |
| Com. Ex. 5 | 2400/88 | — | 18.0/0 | 1.30 | X X | X |
| Com. Ex. 6 | 1700/88 | — | 18.0/0 | 1.31 | X | X |

We claim:

1. A heat sensitive recording material comprising a substrate and a heat sensitive recording layer formed thereon and having incorporated therein a colorless or light-colored basic dye and a color acceptor reactive with the dye when contacted therewith by heating, the heat sensitive recording material being characterized in that the heat sensitive recording layer has incorporated therein a polyvinyl alcohol having an average polymerization degree of at least 1000 and a saponification degree of up to 90 mole % , and at least one modified starch selected from the group consisting of oxidized starch, enzyme converted starch, esterified starch, cationic starch, grafted starch, etherified starch and α-starch.

2. A heat sensitive recording material as defined in claim 1 wherein the polyvinyl alcohol has an average polymerization degree of 1000 to 10000.

3. A heat sensitive recording material as defined in claim 2 wherein the polyvinyl alcohol has an average polymerization degree of 1000 to 5000.

4. A heat sensitive recording material as defined in claim 3 wherein the polyvinyl alcohol has an average polymerization degree of 1700 to 5000.

5. A heat sensitive recording material as defined in claim 1 wherein the polyvinyl alcohol has a saponification degree of 70 to 90 mole %.

6. A heat sensitive recording material as defined in claim 5 wherein the polyvinyl alcohol has a saponification degree of 80 to 90 mole %.

7. A heat sensitive recording material as defined in claim 1 wherein the polyvinyl alcohol has an average polymerization degree of 1000 to 5000 and a saponification degree of 70 to 90 mole %.

8. A heat sensitive recording material as defined in claim 7 wherein the polyvinyl alcohol has an average polymerization degree 1700 to 5000 and a saponification degree of 80 to 90 mole %.

9. A heat sensitive recording material as defined in claim 1 wherein the modified starch has a viscosity of 30 to 10000 cps when a 20% by weight of aqueous solution of the starch is measured at 50° C. by Brookfield viscometer.

10. A heat sensitive recording material as defined in claim 9 wherein the modified starch has a viscosity of 30 to 5000 cps when a 20% by weight of aqueous solution of the starch is measured at 50° C. by Brookfield viscometer.

11. A heat sensitive recording material as defined in claim 1 wherein the ratio in terms of solids of the polyvinyl alcohol to the modified starch is in the range of 10:90 to 80:20.

12. A heat sensitive recording material as defined in claim 11 wherein the ratio in terms of solids of the polyvinyl alcohol to the modified starch is in the range of 15:85 to 60:40.

* * * * *